US010121411B2

(12) United States Patent
Kato

(10) Patent No.: US 10,121,411 B2
(45) Date of Patent: Nov. 6, 2018

(54) DISPLAY DEVICE AND DISPLAY METHOD FOR REDUCING POWER CONSUMPTION OF A SOURCE DRIVER

(71) Applicant: JOLED INC., Tokyo (JP)

(72) Inventor: Toshiyuki Kato, Tokyo (JP)

(73) Assignee: JOLED INC., Tokyo (JP)

( * ) Notice: Subject to any disclaimer, the term of this patent is extended or adjusted under 35 U.S.C. 154(b) by 388 days.

(21) Appl. No.: 14/942,054

(22) Filed: Nov. 16, 2015

(65) Prior Publication Data

US 2016/0148576 A1 May 26, 2016

(30) Foreign Application Priority Data

Nov. 20, 2014 (JP) ..... 2014-235660

(51) Int. Cl.
*G09G 3/3225* (2016.01)
*G09G 3/20* (2006.01)

(52) U.S. Cl.
CPC ..... *G09G 3/3225* (2013.01); *G09G 3/2007* (2013.01); *G09G 2320/0276* (2013.01); *G09G 2320/0673* (2013.01); *G09G 2330/021* (2013.01); *G09G 2330/028* (2013.01); *G09G 2360/16* (2013.01)

(58) Field of Classification Search
None
See application file for complete search history.

(56) References Cited

U.S. PATENT DOCUMENTS

2004/0256617 A1* 12/2004 Yamada ..... G09G 3/325 257/59
2008/0111812 A1* 5/2008 Shirasaki ..... G09G 3/3233 345/212
2008/0303758 A1* 12/2008 Ooishi ..... G09G 3/2033 345/84
2012/0154460 A1* 6/2012 Segawa ..... H01L 27/3276 345/690

FOREIGN PATENT DOCUMENTS

JP 2006-065148 3/2006

* cited by examiner

*Primary Examiner* — David D Davis
(74) *Attorney, Agent, or Firm* — Greenblum & Bernstein, P.L.C.

(57) ABSTRACT

A display device includes pixel units, a source driver and a control unit. The source driver applies voltage corresponding to gray level values to data signal lines. Each of the pixel units includes a light-emitting element, a capacitance element and a driving transistor. The light-emitting element emits light according to a driving current. The capacitance element accumulates charge corresponding to a voltage at a connected data signal line. The driving transistor supplies the driving current corresponding to the accumulated charge to the light-emitting element. The control unit decreases voltage(s) to be outputted from the source driver, when an appearance frequency of display pixels having a low gray-level value is lower than a first reference frequency, or when an appearance frequency of display pixels having a high gray-level value is lower than a second reference frequency.

9 Claims, 12 Drawing Sheets

FIG. 9

| Gray-level value | Without peak compression | With black peak compression | With white peak compression |
|---|---|---|---|
| GL0 | VR0 | – | VRL0 (= VR0 - ΔVR2) |
| GL1 | VR1 | VR1 | VRL1 (= VR2) |
| ... | ... | ... | ... |
| GL(k-1) | VR(k-1) | VR(k-1) | VRL(k-1) (= VRk) |
| GLk | VRk | VRk | VRLk (= VRk - ΔVR2) |

DISPLAY DEVICE AND DISPLAY METHOD FOR REDUCING POWER CONSUMPTION OF A SOURCE DRIVER

CROSS REFERENCE TO RELATED APPLICATION

The present application is based on and claims priority of Japanese Patent Application No. 2014-235660 filed on Nov. 20, 2014. The entire disclosure of the above-identified application, including the specification, drawings and claims is incorporated herein by reference in its entirety.

FIELD

The present disclosure relates to display devices and display methods.

BACKGROUND

As display devices, there are an organic electroluminescent (EL) display, a liquid crystal display, and the like. The organic EL display generally includes an organic EL panel, a source driver, a gate driver, a control unit, and a power circuit.

The organic EL panel includes a plurality of data signal lines extending in a column direction, a plurality of scan lines extending in a row direction, and a plurality of pixel units arranged at cross-points between the data signal lines and the scan lines. Each of the pixel units includes, for example, a sub-pixel unit PR that emits light for red color (R), a sub-pixel unit PG that emits light for green color (G), and a sub-pixel unit PB that emits light for blue color (B).

Each of the sub-pixel units PR, PG, and PB includes an organic EL element that emits light according to a driving current, a capacitance element that accumulates electrical charge corresponding to a voltage applied to a connected data signal line, and a driving transistor that supplies a driving current corresponding to the electrical charge accumulated in the capacitance element to the organic EL element.

The source driver applies, to the data signal lines, voltages each of which corresponds to a gray-level value of a corresponding display pixel among display pixels included in an image indicated by an image signal. The gate driver applies a voltage to a scan line connected to a selected pixel. The control unit outputs an internal control signal to each of the gate driver, the source driver, and the power circuit to control operation of each of the gate driver, the source driver, and the power circuit. The power circuit supplies a power source voltage corresponding to the specification of the circuit, to each of the constituent elements in the organic EL display.

Patent Literature (PTL) 1 below discloses a display device that reduces power consumption by adjusting a cathode voltage (voltage at an electrode line connected to a cathode electrode in an organic EL element) of an organic EL panel to be closer to a power source voltage VDD.

CITATION LIST

Patent Literature

[PTL 1] Japanese Unexamined Patent Application Publication No. 2006-065148

SUMMARY

Technical Problem

However, the display device disclosed in PTL 1 has a problem that the reduction in power consumption of a source driver is not sufficient.

The present discloser provides a display device and a display method which are capable of reducing power consumption of a source driver.

Solution to Problem

The display device according to an aspect of the present disclosure includes a plurality of pixel units, a source driver, and a control unit configured to control operations of the pixel units and the source driver. The source driver applies, to data signal lines connected to the pixel units, voltages corresponding to gray-level values of display pixels included in an image indicated by an image signal. Each of the pixel units includes (i) a light-emitting element that emits light according to a driving current, (ii) a capacitance element that accumulates electrical charge corresponding to a voltage among the voltages which is applied to a data signal line connected to the pixel unit among the data signal lines, and (iii) a driving transistor that supplies the driving current corresponding to the electrical charge accumulated in the capacitance element to the light-emitting element. The driving transistor is a P-channel transistor. The control unit is configured to decrease at least one of the voltages to be outputted from the source driver, when an appearance frequency of at least one display pixel having a low gray-level value among the display pixels is lower than a first reference frequency, or when an appearance frequency of at least one display pixel having a high gray-level value among the display pixels is lower than a second reference frequency. The low gray-level value being lower than or equal to a first reference value. The high gray-level value being higher than or equal to a second reference value.

Advantageous Effects

The display device according to the present disclosure is capable of reducing power consumption of a source driver.

BRIEF DESCRIPTION OF DRAWINGS

These and other objects, advantages and features of the disclosure will become apparent from the following description thereof taken in conjunction with the accompanying drawings that illustrate specific embodiments of the present disclosure.

FIG. 9 is a table indicating a relationship between a voltage outputted from the source driver and a gray-level value according to Embodiment 1.

DESCRIPTION OF EMBODIMENTS

The following describes embodiments in detail with reference to the accompanying drawings. However, unnecessarily detailed description is omitted in some cases. For example, detailed description of well-known matters and repeated description of substantially identical structures may be omitted. This is to avoid unnecessary redundancy in the following description to make those skilled in the art easily understand the description.

Furthermore, the inventors provide the accompanying drawings and the following description to enable those skilled in the art to more fully understand the present disclosure, and have no intention of restricting the subject manner of the claims to the drawings and the description.

Embodiment 1

The following describes Embodiment 1 with reference to FIGS. 1 to 9. In Embodiment 1, an example where a display device is an organic EL display is described. The organic EL display obtains gray-level values of respective display pixels included in an image indicated by an image signal, and decreases a voltage to be outputted from a source driver, when (i) an appearance frequency of display pixels having a low gray-level value that is smaller than or equal to a first reference value or (ii) an appearance frequency of display pixels having a high gray-level value that is greater than or equal to a second reference value is low.

In Embodiment 1, the determination of the appearance frequency is performed by analyzing the image signal. More specifically, the organic EL display counts the number of display pixels having a low gray-level value, and calculates a ratio of the number of the display pixels having a low gray-level value to a total number of the display pixels included in the image (hereinafter, referred to as a "low gray-level ratio") as an appearance frequency. Furthermore, the organic EL display counts the number of display pixels having a high gray-level value, and calculates a ratio of the number of the display pixels having a high gray-level value to the total number of the display pixels included in the image (hereinafter, referred to as a "high gray-level ratio") as an appearance frequency. The organic EL display determines, based on the appearance frequency, whether or not to decrease a voltage to be outputted from the source driver.

[1-1. Structure of Display Device]

Figure 1:
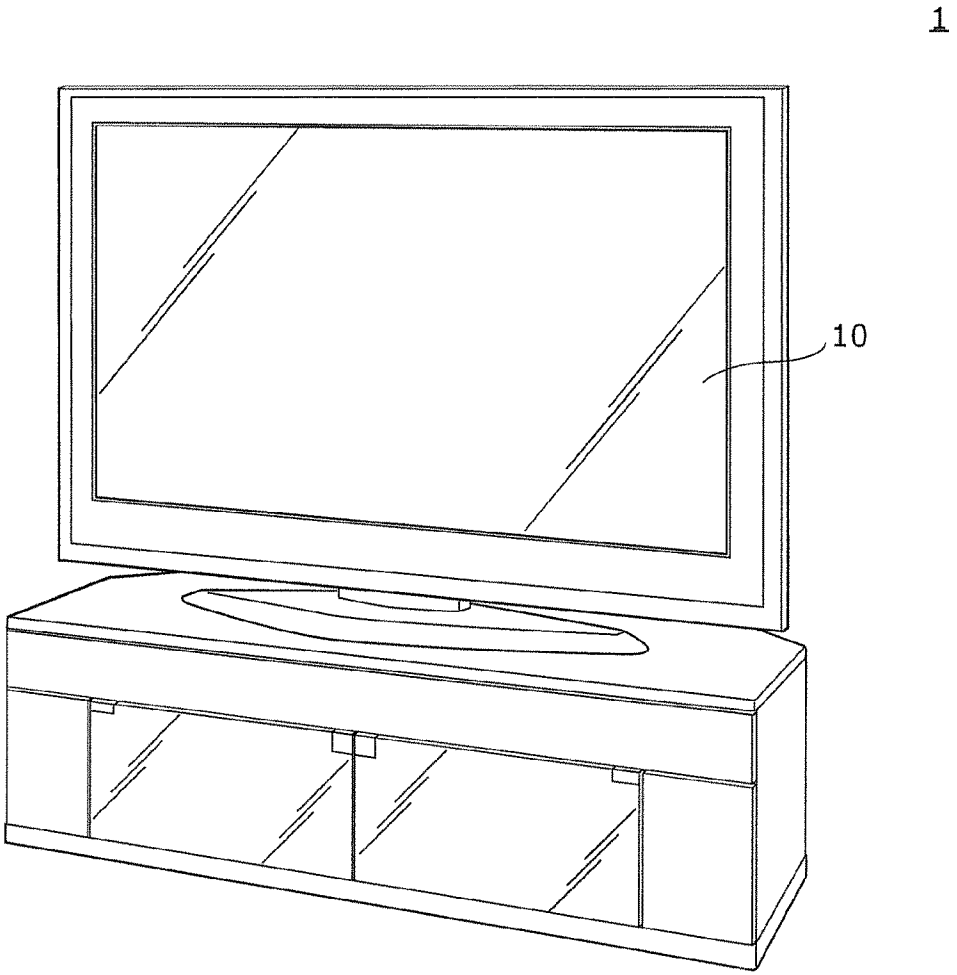
FIG. 1 illustrates an example of an external view of an organic EL display according to Embodiment 1.
Figure 2:
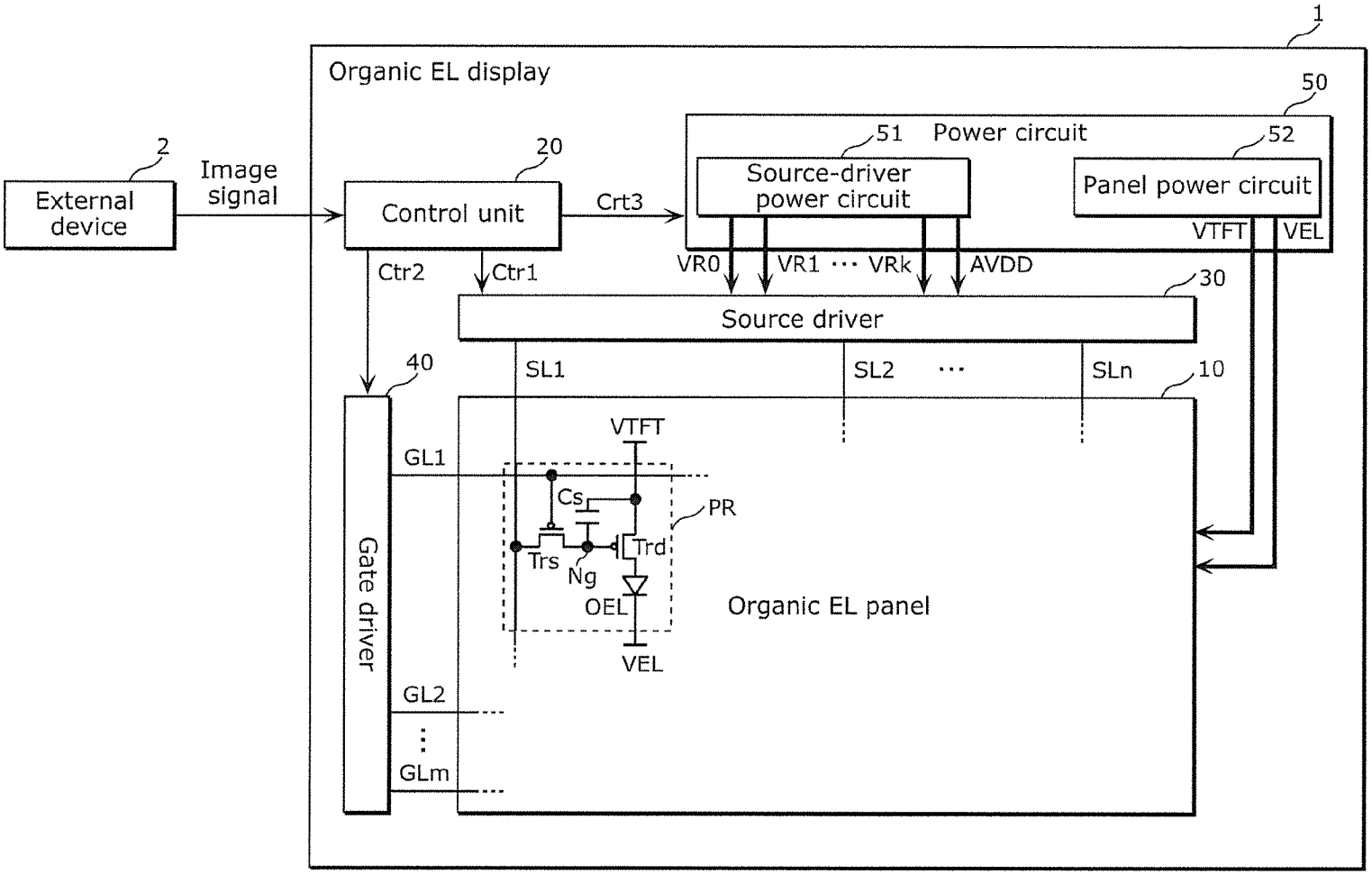
FIG. 2 is a block diagram illustrating an example of a structure of the EL display according to Embodiment 1.

FIG. 1 illustrates an example of an external view of the organic EL display according to Embodiment 1. FIG. 2 is a diagram illustrating an example of a structure of the organic EL display according to Embodiment 1. As illustrated in FIG. 2, the organic EL display 1 includes an organic EL panel 10, a control unit 20, a source driver 30, a gate driver 40, and a power circuit 50.

[Organic EL Panel]

As illustrated in FIG. 2, the organic EL panel 10 includes data signal lines SL1 to SLn extending in a column direction, scan lines GL1 to GLm extending in a row direction, and a plurality of pixel units P each of which is arranged at a different cross-point among a plurality of cross-points between the data signal lines SL1 to SLn and the scan lines GL1 to GLm. In other words, the plurality of pixel units P are arranged in a matrix of m rows and n columns.

Each of the pixel units P includes a sub-pixel unit PR that emits light for red color (R), a sub-pixel unit PG that emits light for green color (G), and a sub-pixel unit PB that emits light for blue color (B). (It should be noted that the pixel unit according to the aspect of the present disclosure corresponds to this sub-pixel unit). The sub-pixel units PR, PG, and PB may be arranged in a row direction, in a column direction, or in a matrix.

As illustrated in FIG. 2, the sub-pixel unit PR includes an organic EL element OEL, a capacitance element Cs, and a selection transistor Trs, and a driving transistor Trd.

The organic EL element OEL is a light-emitting element that emits light according to a driving current. In Embodiment 1, the organic EL element OEL is a light-emitting element that emits white light. The driving current is supplied from the driving transistor Trd. An anode electrode of the organic EL element OEL is connected to a drain electrode of the driving transistor Trd, and a cathode electrode of the organic EL element OEL is connected to a power line VEL (VEL has, for example, a ground voltage).

The capacitance element Cs is a capacitance element in which electrical charge corresponding to a voltage at a data signal line SL connected to the sub-pixel unit PR are accumulated. A first electrode of the capacitance element Cs is connected to a gate electrode of the driving transistor Trd, and a second electrode of the capacitance element Cs is connected to a source electrode of the driving transistor Trd. In FIG. 2, a connection node between the first electrode of the capacitance element Cs and the gate electrode of the driving transistor Trd is illustrated as a node Ng.

The driving transistor Trd supplies to the organic EL element OEL a driving current corresponding to an amount of electrical charge accumulated in the capacitance element Cs, according to the voltage at the data signal line SL. The driving transistor Trd is a P-channel (hereinafter, referred to also appropriately as "Pch") transistor. The gate electrode of the driving transistor Trd is connected to the first electrode of the capacitance element Cs, the source electrode of the driving transistor Trd is connected to the second electrode of the capacitance element Cs and the power line VTFT, and the drain electrode of the driving transistor Trd is connected to the anode electrode of the organic EL element OEL.

The selection transistor Trs is a switch element that switches a conductive state and a non-conductive state between the data signal line SL and the first electrode of the capacitance element Cs according to a voltage at a scan line GL connected to the sub-pixel unit PR.

Furthermore, a color filter (not illustrated) that transmits light having a wavelength of red color is provided to the front side of the organic EL element OEL in the sub-pixel unit PR.

The structure of each of the sub-pixel units PG and PB is the same as the structure of the sub-pixel unit PR except the properties of the color filter. A color filter that transmits light having a wavelength of green color is provided to the front side of an organic EL element OEL in the sub-pixel unit PG corresponding to green color. A color filter that transmits light having a wavelength of blue color is provided to the front side of an organic EL element OEL in the sub-pixel unit PB corresponding to blue color.

Each of the color filters may be formed by, for example, vapor deposition using mask, but the method of forming the color filter is not limited to this example. For example, it is possible to form an organic EL element for blue light emission, and provide a color change layer (Color Change Mediums (CCM)) for changing the blue light into red color (R), green color (G), and blue color (B) to the organic EL element.

Although it has been described in Embodiment 1 that each of the sub-pixel units includes an organic EL element OEL that emits white light and a color filter that transmits a corresponding color is provided to each of the sub-pixel units. However, the present disclosure is not limited to this example. For example, the organic EL element OEL may be formed to comprise a material corresponding to a target color.

Although the selection transistor Trs and the driving transistor Trd are thin-film transistors in Embodiment 1, the present disclosure is not limited to this example. Each of the selection transistor Trs and the driving transistor Trd may be an Field-Effect Transistor (FET), a Metal-Oxide Semiconductor (MOS)-FET, a MOS transistor, a bipolar transistor, or the like. Furthermore, the selection transistor Trs is not limited to a transistor, but may be an analog switch or the like.

[Source Driver]

The source driver 30 is a circuit that outputs, to each of the data signal lines SL1 to SLn, a data signal corresponding to a first control signal Ctr1 outputted from the control unit 20.

Figure 3:
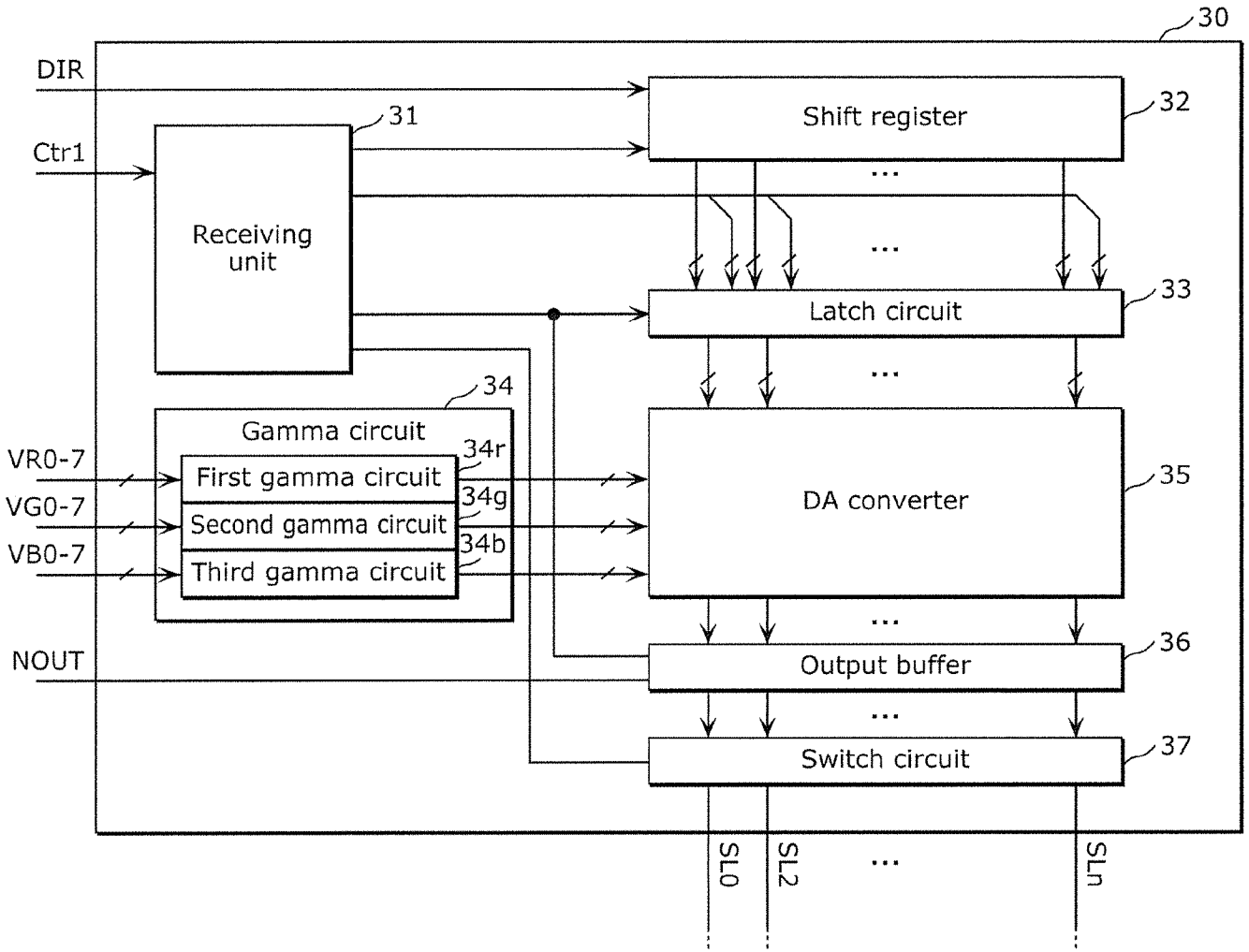
FIG. 3 is a block diagram illustrating an example of a structure of a source driver according to Embodiment 1.

FIG. 3 is a block diagram illustrating an example of a structure of the source driver 30 according to Embodiment 1. As illustrated in FIG. 3, the source driver 30 includes a receiving unit 31, a shift register 32, a latch circuit 33, a gamma circuit 34, a Digital-to-Analog (DA) converter 35, an output buffer 36, and a switch circuit 37.

The receiving unit 31 obtains gray-level values of the respective display pixels included in the image (values equivalent to the gray-level values) by analyzing the first control signal Ctr1 received from the control unit 20, and sequentially transmits the obtained gray-level values to the shift register 32. Furthermore, the receiving unit 31 gives the latch circuit 33 an instruction on a timing at which values outputted from the shift register 32 are to be latched. The timing is a timing at which all gray-level values in the same row are accumulated in the shift register 32.

The shift register 32 is capable of holding pieces of data indicating gray-level values of one row of the organic EL panel 10. Each time a piece of data is inputted from the receiving unit 31, the shift register 32 sequentially shifts the pieces of accumulated data to a direction indicated by a signal DIR, and stores the piece of data inputted from the receiving unit 31 at the end of the pieces of accumulated data. The shift register 32 constantly outputs, in parallel, pieces of accumulated data of one row to the latch circuit 33.

The latch circuit 33 latches the pieces of data of one row which are outputted from the shift register 32 at the timing indicated by the receiving unit 31. The latch circuit 33 outputs, in parallel, the latched pieces of data of one row to the DA converter. It should be noted that the latch circuit 33 may have a structure capable of latching pieces of data of a plurality of rows.

The gamma circuit 34 stabilizes and outputs reference voltages VR0 to VR7, VG0 to VG7, and VB0 to VB7 which have been generated in the power circuit 50 as described later. As illustrated in FIG. 3, the gamma circuit 34 includes a first gamma circuit 34*r* corresponding to red (R), a second gamma circuit 34*g* corresponding to green (G), and a third gamma circuit 34*b* corresponding to blue (B).

Figure 4:
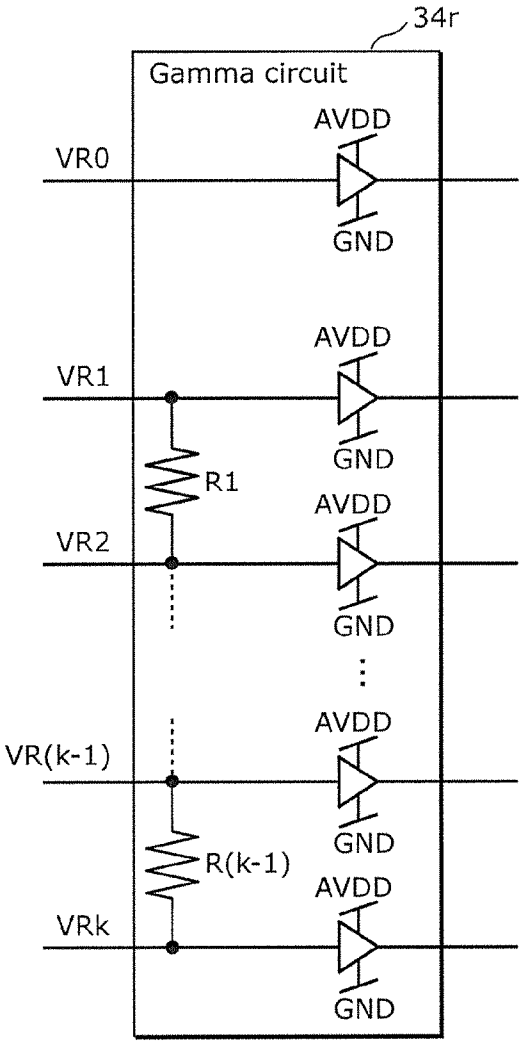
FIG. 4 is a circuit diagram illustrating an example of a gamma circuit included in the source driver according to Embodiment 1.

FIG. 4 is a circuit diagram illustrating an example of the first gamma circuit 34*r* included in the source driver 30 according to Embodiment 1. As illustrated in FIG. 4, the first gamma circuit 34*r* includes circuits that independently drive the reference voltages VR0 to VRk, and (k−1) resistance elements R1 to Rk. Here, k is a total number of gray-level values−1, for example, 255, in the case of gray-level values from 0 to 255, inclusive. The resistance elements Rh (where h is in a rage from 1 to (k−1), inclusive) has one end connected to a power line for transmitting a reference voltage VRh, and the other end connected to a power line for transmitting a reference voltage VR(h+1). The first gamma circuit 34*r* causes any adjacent voltages among the reference voltages VR1 to VRk to have the same difference.

The DA converter 35 performs digital-to-analog conversion on the pieces of data outputted from the latch circuit 33 by using the reference voltages outputted from the gamma circuit 34.

The output buffer 36 is a circuit that outputs the pieces of data outputted from the DA converter 35 to the data signal lines SL via the switch circuit 37. It should be noted that the output buffer 36 may include a delay circuit.

Figure 5:
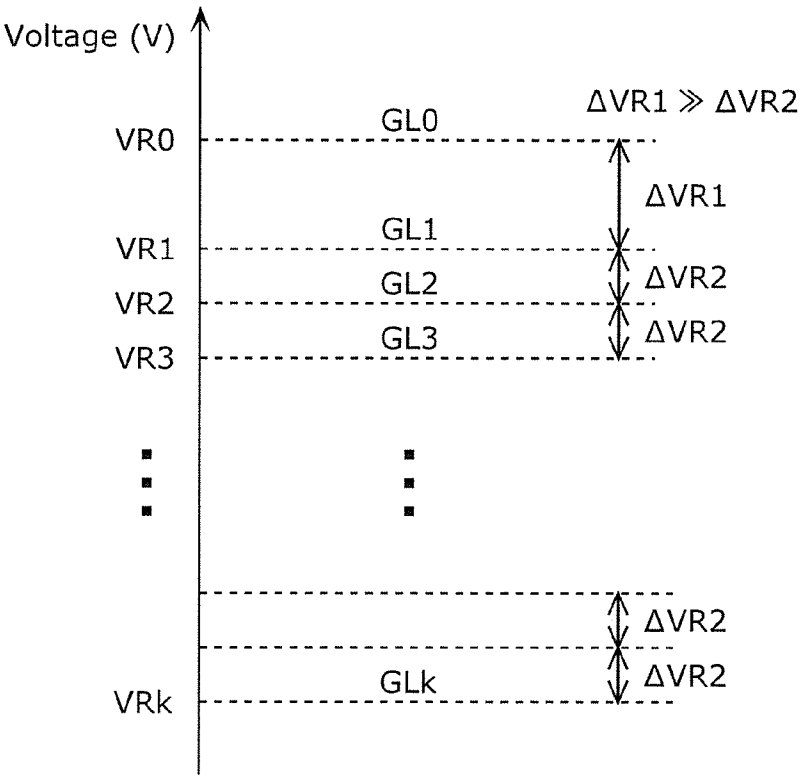
FIG. 5 is a diagram illustrating a relationship between a voltage outputted from the source driver and a gray-level value.

FIG. 5 is a diagram illustrating a relationship between a voltage outputted from the source driver 30 and a gray-level value in the case where the voltage the source driver 30 is not decreased. As illustrated in FIG. 5, the source driver 30 outputs reference voltages VR0 to VRk corresponding to gray-level values GL0 to GLk, respectively. In Embodiment 1, the gray-level value GL0 is 0 and corresponds to black color. The gray-level value GLk is the greatest gray-level value, namely, a value of 255 in Embodiment 1, and corresponds to white color.

In the case where the driving transistor Trd is a P-channel transistor, a luminance of the organic EL element OEL decreases as a reference voltage VR of a data signal line with reference to the driving voltage VTFT (voltage outputted from the power line VTFT) applied to the source electrode of the driving transistor Trd becomes higher. Therefore, in FIG. 5, a voltage value is getting smaller in order of the reference voltages from VR0 to VRk.

Furthermore, as illustrated in FIG. 5, a voltage difference between the reference voltage VR0 and the reference voltage VR1 is ΔVR1. Regarding the reference voltages VR1 to VRk, a difference between adjacent reference voltages, in other words, VRh−VR(h+1), is fixed to ΔVR2.

Furthermore, the voltage difference ΔVR1 is sufficiently greater than the voltage difference ΔVR2, in other words, ΔVR1>>ΔVR2. The reason the voltage difference ΔVR1 between the reference voltage VR0 and the reference voltage VR1 is set to be greater than the voltage difference ΔVR2 is because the setting prevents black color from floating due to voltage variations. Since the voltage difference ΔVR1 is set to a value greater than the voltage difference ΔVR2, in the first gamma circuit 34*r* of FIG. 4, the circuit that drives the reference voltage VR0 is independent from the circuits for driving the other reference voltages VR1 to VRk.

[Gate Driver]

The gate driver 40 applies, to a scan line GL connected to a selected row, a voltage for turning on a selection transistor Trs connected to the scan line GL, according to a second control signal outputted from the control unit 20. Furthermore, the gate driver 40 applies, to scan lines GL in non-selected rows, a voltage for turning off selection transistors Trs connected to the scan lines GL.

[Power Circuit]

The power circuit 50 generates, from power supplied from an external power source, a power source voltage to be supplied to each of the circuits included in the organic EL display 1. It should be noted that FIG. 2 illustrates a source-driver power circuit 51 that supplies reference voltages VR0 to VRk to the source driver 30, and a panel power circuit 52 that supplies a driving voltage VTFT and a power source VEL in the low voltage side to the organic EL panel 10.

[Control Unit]

The control unit 20 controls displaying of an image on the organic EL panel 10. The control unit 20 generates a decoded signal by decoding an image signal received from an external device 2 provided to the outside of the organic EL display 1. Then, the control unit 20 generates from the decoded signal (i) a first control signal Ctr1 for determining an operation of the source driver 30 and (ii) a second control signal Ctr2 for determining an operation of the gate driver 40. The control unit 20 further generates from the decoded signal (iii) a third control signal Ctr3 for determining an operation of the power circuit 50.

An example of the control unit 20 is a timing controller. The following describes an example where the control unit 20 is implemented to a dedicated Large Scale Integration (LSI) circuit, but the control unit 20 is not limited to this example. The control unit 20 may be, for example, a computer system that includes a microprocessor (MPU), a read-only memory (ROM), a random access memory (RAM), and the like. In this case, the operations described above can be performed by the microprocessor operating according to a computer system for realizing each of the operations.

Figure 6:
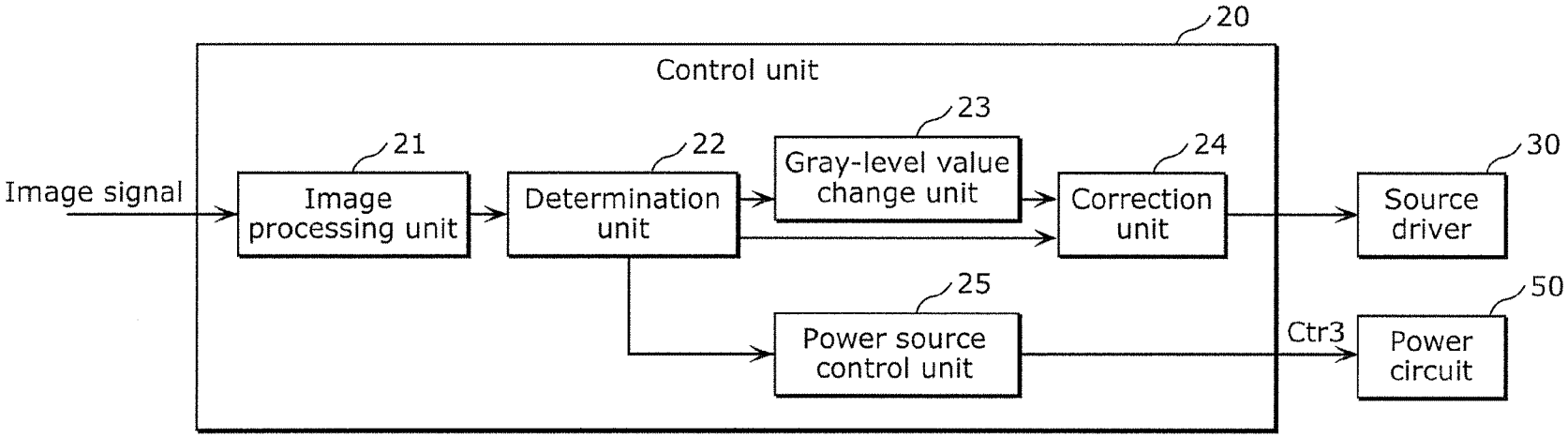
FIG. 6 is a block diagram illustrating an example of a structure of a control unit according to Embodiment 1.

FIG. 6 is a block diagram illustrating an example of a structure of the control unit 20 according to Embodiment 1. As illustrated in FIG. 6, the control unit 20 includes an image processing unit 21, a determination unit 22, a gray-level value change unit 23, correction unit 24, and a power source control unit 25.

The image processing unit 21 performs decoding of coded signals, adjustment of an image size, and the like.

The determination unit 22 calculates: an appearance frequency of display pixels having a low gray-level value; and an appearance frequency of display pixels having a high gray-level value. The determination unit 22 determines, based on the appearance frequencies, whether or not to decrease a voltage to be outputted from the source driver 30. Although the plurality of display pixels are display pixels in one frame and an appearance frequency is determined for each frame in Embodiment 1, the present disclosure is not limited to this case.

The processing for decreasing a voltage to be outputted from the source driver 30 includes (i) black peak compression by which gray-level value(s) is/are changed if an appearance frequency of display pixels having a low gray-level value is low, and (ii) white peak compression by which the power circuit is controlled if an appearance frequency of display pixels having a high gray-level value is low. The determination unit 22 determines which is to be performed between the black peak compression and the white peak compression, based on the appearance frequency of display pixels having a low gray-level value and the appearance frequency of display pixels having a high gray-level value. The operation performed by the determination unit 22 will be described in more detail in the description of operations below.

The gray-level value change unit 23 changes gray-level value(s) if it is determined that the black peak compression is to be performed. A method for changing gray-level value(s) will be described in more detail in the description of operations below.

The correction unit 24 performs correction and the like on inputted gray-level values according to deterioration over time occurred in the organic EL element OEL.

The power source control unit 25 generates the third control signal Ctr3, when it is determined that the white peak compression is to be performed. The control method performed by the determination unit 50 will be described in more detail in the description of operations below.

[1-2. Operations (Display Method)]

The following describes the operations performed by the organic EL display 1 having the above-described structure. The organic EL display 1 performs processing for decreasing a voltage to be outputted from the source driver 30, if an appearance frequency of display pixels having a low gray-level value is low. Furthermore, the organic EL display 1 performs processing for decreasing a voltage to be outputted from the source driver 30, if an appearance frequency of display pixels having a high gray-level value is low.

Figure 7:
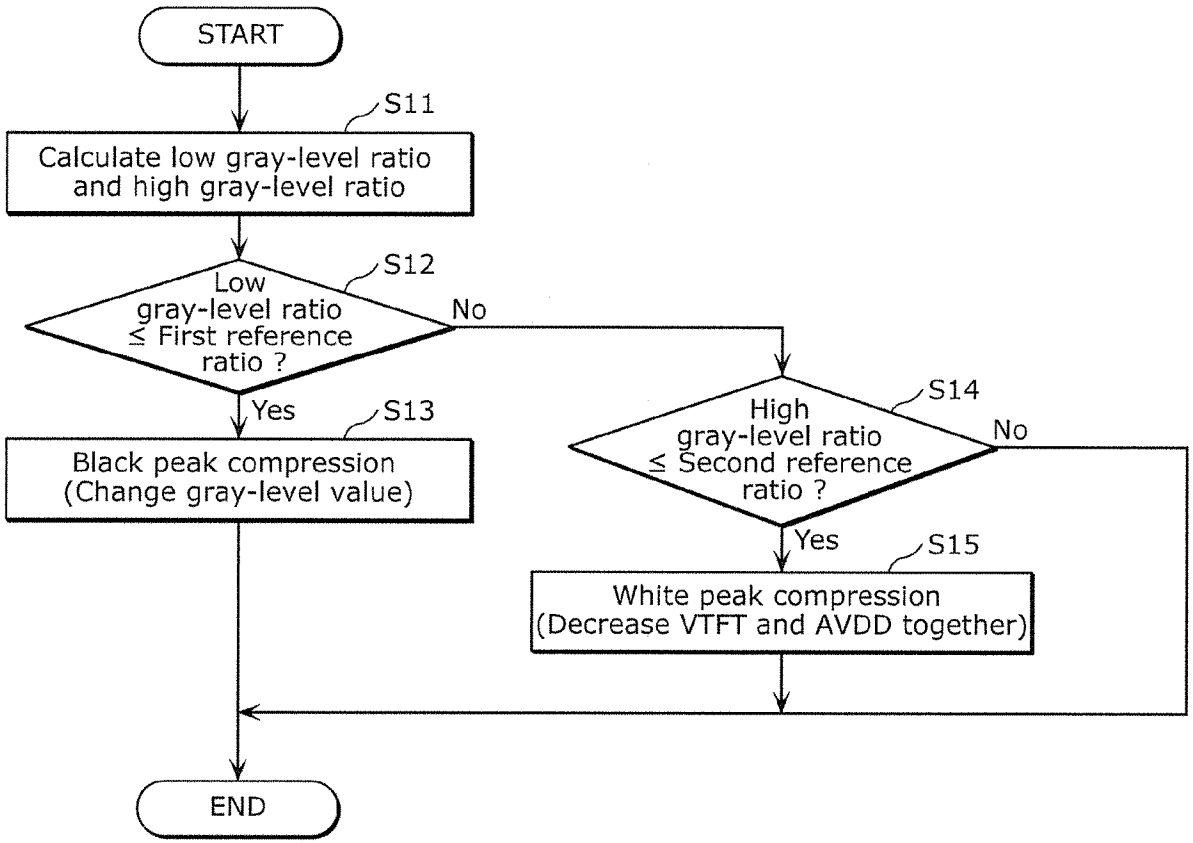
FIG. 7 is a flowchart of an example of processing for decreasing a voltage to be outputted from the source driver according to Embodiment 1.

FIG. 7 is a flowchart of an example of the processing for decreasing a voltage to be outputted from the source driver 30 in the organic EL display 1 according to Embodiment 1.

The control unit 20 obtains gray-level values corresponding to the respective display pixels from an image signal decoded by the image processing unit 21. The determination unit 22 counts the number of display pixels having a low gray-level value that is smaller than or equal to a first reference value and the number of display pixels having a high gray-level value that is greater than or equal to a second reference value (Step S11).

The determination unit 22 determines whether or not a ratio of the number of the display pixels having a low gray-level value to a total number of the display pixels included in the image (hereinafter, referred to as a "low gray-level ratio") is lower than or equal to a first reference ratio (Step S12).

Figure 8B:
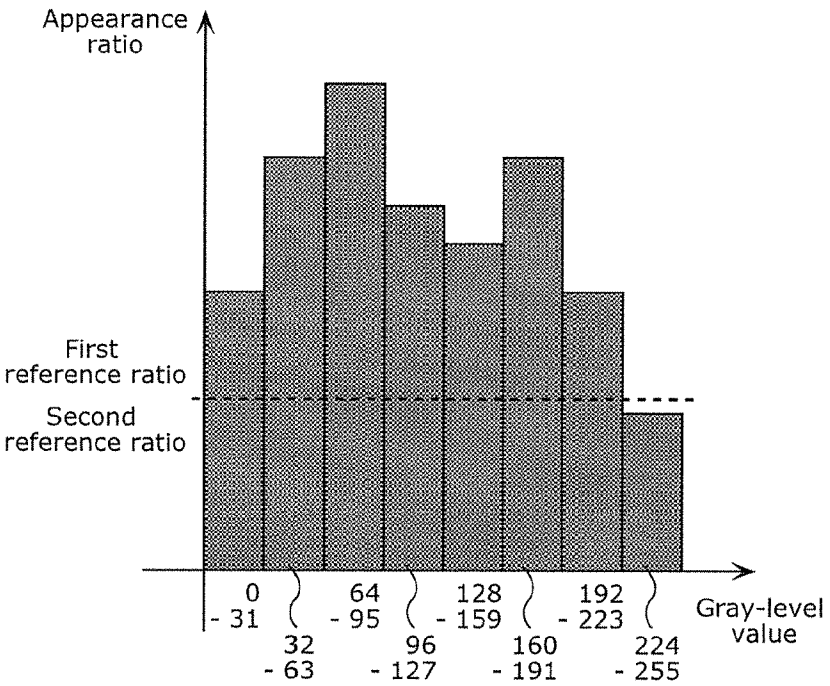
FIG. 8B is a histogram illustrating distribution of gray-level values of image signal.
Figure 8A:
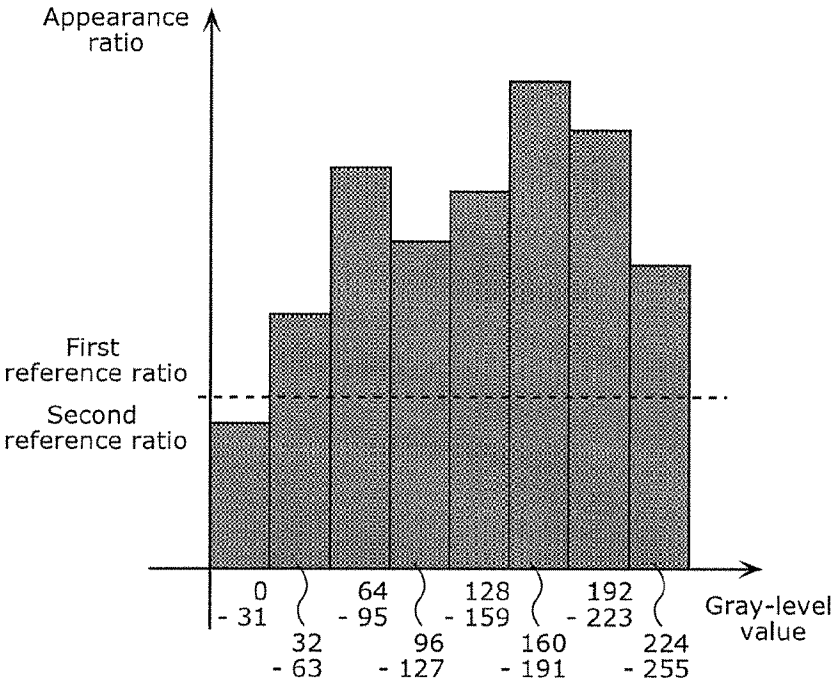
FIG. 8A is a histogram illustrating distribution of gray-level values of image signal.

Each of FIG. 8A and FIG. 8B is a histogram illustrating distribution of gray-level values of an image signal. In each of the histograms illustrated in FIG. 8A and FIG. 8B, in the case where the gray-level values are in a range from 0 to 255, inclusive, the gray-level values are divided into eight groups. All the groups have the same size of range (gray-level values in a range from 0 to 255, inclusive, is equally divided into eight groups). In the cases of FIG. 8A and FIG. 8B, the first reference value is 31, and gray-level values in a range from 0 to 31, inclusive, are low gray-level values. Furthermore, the second reference value is 224, and gray-level values in a range from 224 to 255, inclusive, are high gray-level values.

Furthermore, in FIG. 8A and FIG. 8B, each of the first reference ratio and the second reference ratio is 6.25%. More specifically, a total number of the display pixels included in one frame (in other words, a total number of pixel units) is divided by eight to obtain 12.5% that is a percentage of the number of display pixels in each group, and a half of the percentage is used as each of the first reference ratio and the second reference ratio.

Here, the number of groups by which the total number is divided may be not only eight but also four or any number. Although in FIG. 8A, each of the groups is assigned with 32 gray-level values, the number of assigned gray-level values may be different among the groups. For example, it is possible to classify gray-level values into three groups: a low gray-level value group (group to which display pixels having gray-level values in a range from 0 to 31, inclusive, belongs), a high gray-level value group (group to which display pixels having gray-level values in a range from 224 to 255, inclusive, belongs), and the other gray-level value group (group to which display pixels having gray-level values in a range from 32 to 223, inclusive, belongs). It is further possible to generate two or more low gray-level value groups and two or more high gray-level value groups.

Furthermore, each of the first reference ratio and the second reference ratio is not limited to the above-described ratio. Each of the first reference ratio and the second reference ratio may be determined according to the properties of the image or the properties of the organic EL display 1. Each of the first reference ratio and the second reference ratio may be, for example, a ratio lower than 1/the number of groups. For example, it is possible that gray-level values are divided into four groups and that each of the first reference ratio and the second reference ratio is set to $(1/4)/2\times100=12.5\%$. Although the first reference ratio and the second reference ratio are identical ratios in Embodiment 1, the first reference ratio and the second reference ratio may be different ratios.

Furthermore, in actual processing, the determination unit 22 does not necessarily count the number of display pixels for each of the groups. The determination unit 22 may count the number of display pixels only for a group of low gray-level values and a group for high gray-level values.

In the case of FIG. 8A, the low gray-level ratio is determined as lower than or equal to the first reference ratio, and in the case of FIG. 8B, the low gray-level ratio is determined as higher than the first reference ratio.

As illustrated in FIG. 7, when the determination unit 22 determines that the low gray-level ratio is lower than or equal to the first reference ratio (Yes at Step S12), then the determination unit 22 provides the gray-level values of the respective display pixels included in the image to the gray-level value change unit 23. In this case, the determination unit 22 does not output a signal to the power source control unit 25 and the correction unit 24.

When receiving the gray-level values of the respective display pixels included in the image from the determination unit 22, the gray-level value change unit 23 performs the black peak compression to change at least one of received gray-level values (Step S13). More specifically, the gray-level value change unit 23 changes a gray-level value of any display pixel having a gray-level value of 0 to a value of 1. In other words, the gray-level value change unit 23 increases the smallest gray-level value of a display pixel, when the appearance frequency of display pixels having a low gray-level value is lower than the first reference frequency (the first reference ratio). The gray-level value change unit 23 provides the gray-level values of the respective display pixels which include the changed gray-level value(s), to the correction unit 24.

On the other hand, if the determination unit 22 determines that the low gray-level ratio is higher than the first reference ratio (No at Step S12), then the black peak compression is not performed, and the determination unit 22 further determines whether or not a ratio of the number of display pixels having a high gray-level value to the total number of the display pixels included in the image (hereinafter, referred to as a "high gray-level ratio") is lower than or equal to a second reference ratio (Step S14). The determination as to whether or not the high gray-level ratio is lower than or equal to the second reference ratio is performed in the similar manner to Step S12.

As illustrated in FIG. 7, if the determination unit 22 determines that the high gray-level ratio is lower than or equal to the second reference ratio (Yes at Step S14), then the determination unit 22 outputs a third control signal Ctr3 indicating control of a power source to the power source control unit 25, and provides the gray-level values of the respective display pixels included in the image to the correction unit 24.

When receiving the third control signal Ctr3 from the determination unit 22, the power source control unit 25 decreases both the power source voltage AVDD supplied to the source driver 30 and the driving voltage VTFT supplied to the sub-pixel units PR, PG, and PB (Step S15). An amount of decrease in the power source voltage AVDD is determined, for example, to cause an amount of decrease in the reference voltage VR to be ΔVR2 as indicated in FIG. 5. The decreasing the driving voltage VTFT and the power source voltage AVDD together can cause an amount of the electrical charge in the capacitance element Cs to be equal to an amount in the case where the control of the power source voltage is not performed. In other words, the control of the power source voltage can prevent change of the gate-source voltage of the driving transistor Trd and change of a luminance of the organic EL element OEL (however, except for any sub-pixel unit corresponding to a display pixel having the greatest gray-level value).

As illustrated in FIG. 7, if the determination unit 22 determines that the high gray-level ratio is higher than the second reference ratio (No at Step S14), then the determination unit 22 provides the gray-level values of the respective display pixels included in the image to the correction unit 24. In this case, the determination unit 22 does not output a third control signal Ctr3 to the power source control unit 25.

[1-3. Effects and the Others]

FIG. 9 is a table indicating a relationship between a voltage outputted from the source driver 30 and a gray-level value in the organic EL display 1 according to Embodiment 1.

If a voltage to be outputted from the source driver 30 is not decreased (in the case without peak compression), the source driver 30 outputs a reference voltage in a range from VR0 to VRk according to a gray-level value of each of the display pixels.

On the other hand, with the black peak compression (in the case where Step S13 in FIG. 7 is performed), every gray-level value GL0 is changed to a gray-level value GL1 so that the source driver 30 does not output the reference voltage VR0. Here, power consumption of the source driver 30 is large, when a voltage difference between data signal lines is great. Furthermore, as illustrated in FIG. 5, the reference voltage VR0 is much higher than the reference voltage VR1. Therefore, avoiding using the reference voltage VR0 results in decrease of a voltage difference between data signal lines. More specifically, a voltage difference between a data signal line connected to a sub-pixel unit corresponding to a display pixel having a gray-level value of 0 and a data signal line in am immediately previous frame is conventionally VR0–VRx, where VRx is a voltage of the data signal line in the immediately previous frame. In contrast, in Embodiment 1, the voltage difference between data signal lines is VR1−VRx. Since VR0» VR1, VR0−VRx» VR1−VRx. This means that the organic EL display 1 according to Embodiment 1 is capable of decreasing a voltage difference between data signal lines and thereby reducing power consumption of the source driver 30.

As described previously, with the black peak compression, a sub-pixel unit corresponding to a display pixel having a gray-level value GL0 has a luminance of a gray-level value GL1. It is therefore inferred that the black peak compression may affect image quality. However, if the first reference ratio to be used in the determination as to whether or not to perform the black peak compression is determined in consideration of the affecting of image quality, it is inferred that deterioration of image quality can be reduced to a degree not causing a problem, because the black peak compression is performed when the low gray-level ratio is lower than or equal to the first reference ratio. If there is no display pixel having a gray-level value of 0, it is inferred that image quality is not deteriorated.

With the while peak compression (in the case where Step S15 of FIG. 7 is performed), if an amount of decrease in the power source voltage AVDD is determined to cause an amount of decrease in the reference voltage VR to be IVR2 as indicated in FIG. 5, the reference voltage VRL0 becomes VR0−ΔVR2. The reference voltages VRL1 to VRL(k−1) have the same voltage values as the reference voltages VR2 to VRLk, respectively. The reference voltage VRLk becomes VRk−ΔVR2.

With the while peak compression, the decrease of a voltage value of the driving voltage VTFT together with a voltage value of the voltage AVDD causes a gate-source voltage at the driving transistor Trd illustrated in FIG. 2 to be equal to a gate-source voltage in the case where the voltage to be outputted from the source driver 30 is not decreased. Therefore, each sub-pixel unit corresponding to a display pixel having a low gray-level value has the same luminance as a luminance in the case without the peak compression.

However, it is inferred that in some cases a sub-pixel unit corresponding to a display pixel having the greatest gray-level value fails to keep the gate-source voltage. In this case, a difference between a luminance of a pixel unit corresponding to a display pixel having the greatest gray-level value and a luminance of a pixel unit corresponding to a display pixel having a gray-level value that is the greatest gray-level value−1 is decreased and affects image quality. However, like the case of the black peak compression, if the second reference ratio to be used in the determination as to whether or not to perform the white peak compression is determined in consideration of affecting of image quality, it is inferred that the deterioration of the image quality can be reduced to a degree not causing a problem because the white peak compression is performed when a high gray-level ratio is lower than or equal to the second reference ratio. If there is no display pixel having the greatest gray-level value (in Embodiment 1, a gray-level value of 255), it is inferred that image quality is not deteriorated.

As described above, the organic EL display according to Embodiment 1 is capable of decreasing a voltage to be outputted from the source driver 30 by changing gray-level values or decreasing the voltages AVDD and VTFT together, thereby reducing power consumption of the source driver 30.

Embodiment 2

Figure 10:
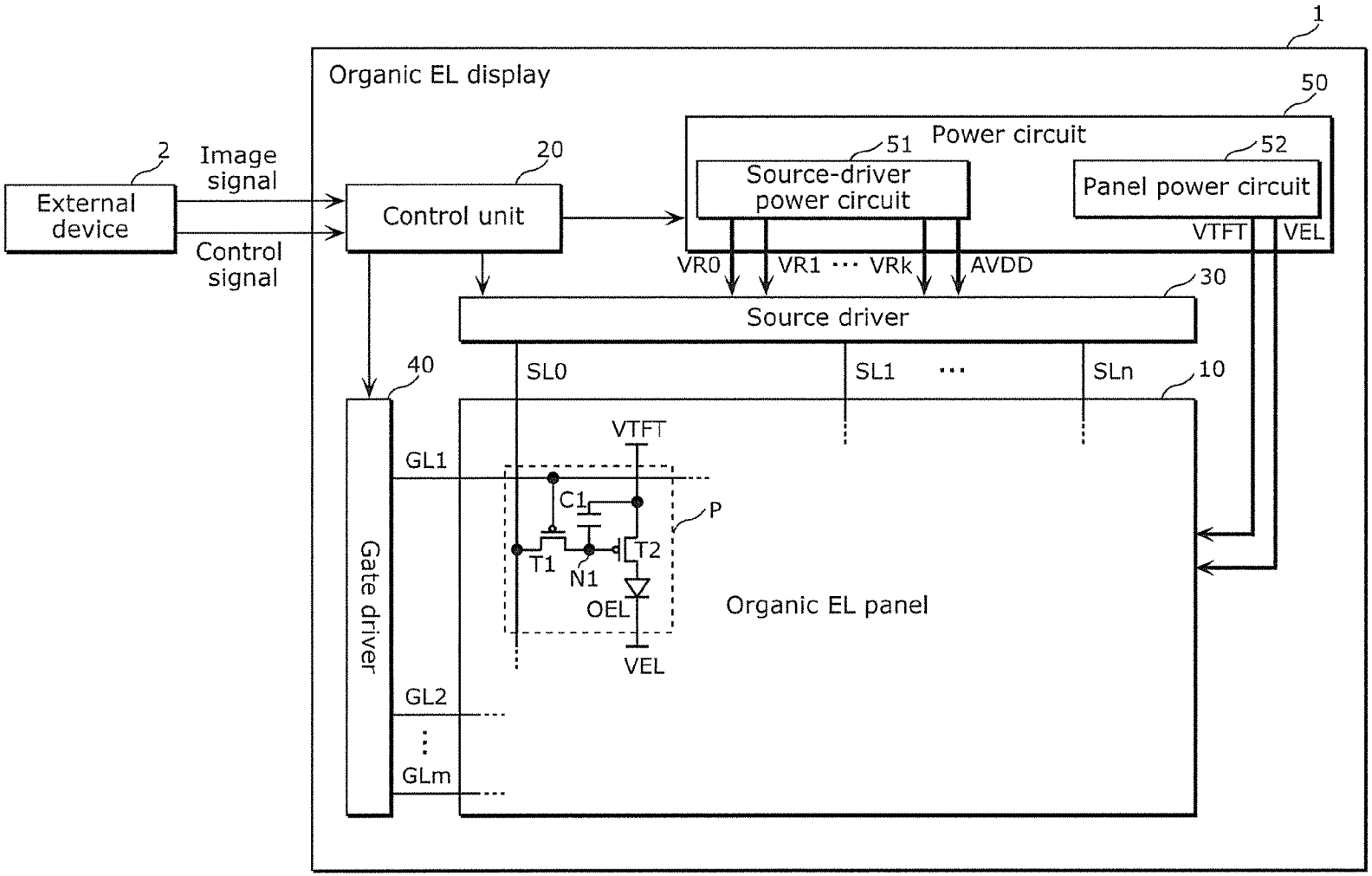
FIG. 10 is a diagram illustrating an example of a structure of an organic EL display according to Embodiment 2.
Figure 11:
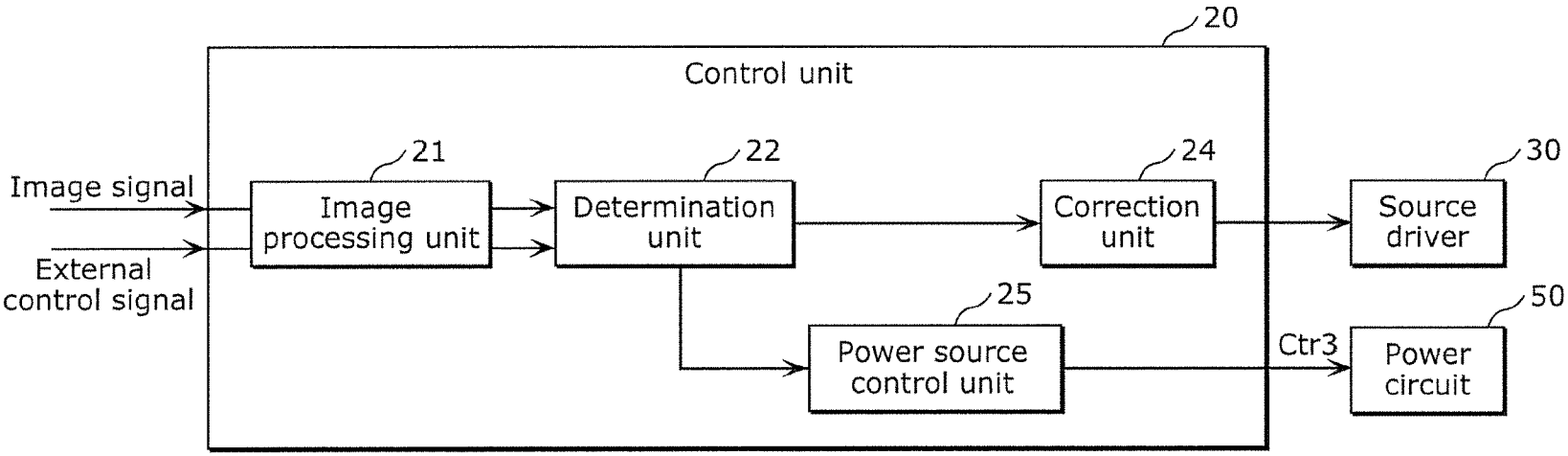
FIG. 11 is a block diagram illustrating an example of a structure of a control unit according to Embodiment 2.
Figure 12:
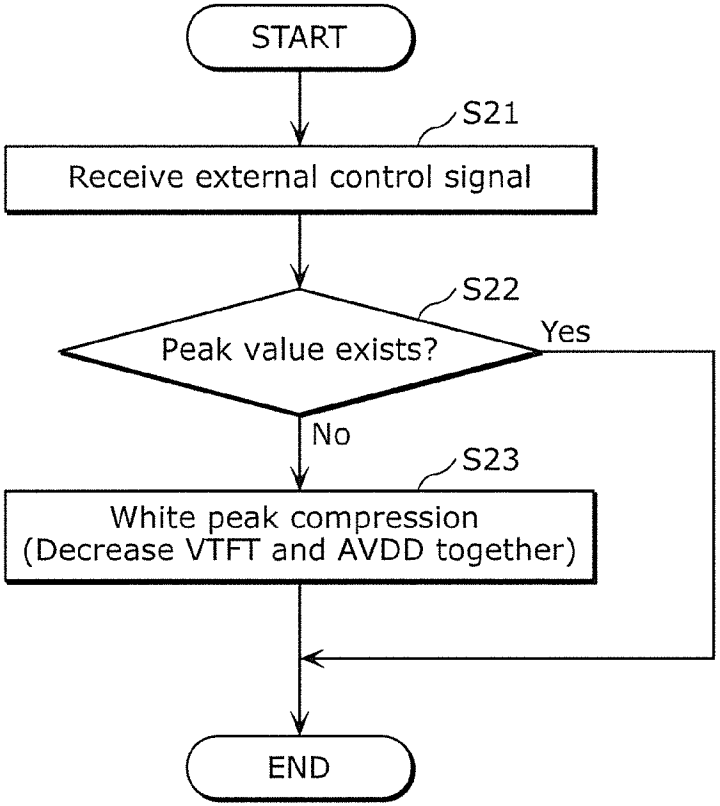
FIG. 12 is a flowchart of an example of processing for decreasing a voltage to be outputted from a source driver according to Embodiment 2.

The following describes Embodiment 2 with reference to FIGS. 10 to 12. Like Embodiment 1, an organic EL display according to Embodiment 2 decreases a voltage to be outputted from a source driver when an appearance frequency of display pixels having a low gray-level value or an appearance frequency of display pixels having a high gray-level value is low.

In Embodiment 1, the determination as to whether or not to perform the peak compression is made based on an analysis result of an image signal (the number of display pixels having a low gray-level value and the number of display pixels having a high gray-level value). In Embodiment 2, however, it is determined whether or not to decrease a voltage to be outputted from a source driver, based on an external control signal inputted from the external device 2 (the external control signal corresponds to the control signal according to the aspect of the present disclosure).

[2-1. Structure of Display Device]

FIG. 10 is a diagram illustrating an example of a structure of the organic EL display according to Embodiment 2. It should be noted that the organic EL display according to Embodiment 2 receives not only the image signal but also an external control signal from the external device 2.

As illustrated in FIG. 10, the organic EL display according to Embodiment 2 includes the organic EL panel 10, a control unit 20, the source driver 30, the gate driver 40, and the power circuit 50. The structures of the organic EL panel 10, the source driver 30, the gate driver 40, and the power circuit 50 are the same as the structures described in Embodiment 1.

The control unit 20 controls displaying of an image on the organic EL panel 10. It should be noted that the control unit 20 performs the same operations as described in Embodiment 1 except operations of the determination unit 22. Like Embodiment 1, the control unit 20 may be implemented to a timing controller, a dedicated LSI, a computer system, or the like.

As illustrated in FIG. 11, the control unit 20 includes the image processing unit 21, a determination unit 22, the correction unit 24, and the power source control unit 25. The structures of the image processing unit 21, the correction unit 24, and the power source control unit 25 are the same as the structures described in Embodiment 1.

The determination unit 22 determines, based on an external control signal provided from the outside, whether or not the display pixels in the image include any display pixel having the greatest gray-level value (peak value). If the display pixels in the image include any display pixel having the peak value, then the determination unit 22 determines not to decrease a voltage to be outputted from the source driver 30. On the other hand, if the display pixels in the image do not include any display pixel having the peak value, then the determination unit 22 determines to decrease the voltage to be outputted from the source driver 30. An example of the external control signal is a peak luminance signal indicating whether or not the display pixels in the image include any display pixel having the peak value (the greatest gray-level value). The determination unit 22 decreases a voltage to be outputted from the source driver 30 if the peak luminance signal indicates that the display pixels included in the image include any display pixel having the peak value.

[2-2. Operations (Display Method)]

The following describes the operations performed by the organic EL display having the above-described structure. In Embodiment 2, the organic EL display 1 performs processing for decreasing a voltage to be outputted from the source driver 30 when the peak luminance signal indicates that the display pixels in the image include any display pixel having the peak value.

FIG. 12 is a flowchart of an example of the processing for decreasing a voltage to be outputted from the source driver 30 in the organic EL display 1 according to Embodiment 2.

The control unit 20 obtains gray-level values corresponding to the respective display pixels included in an image of one frame, from an image signal decoded by the image processing unit 21.

The determination unit 22 receives a peak luminance signal (Step S21), and determines whether or not the peak luminance signal is a signal indicating that the display pixels in the image include any display pixel having the peak value (Step S22).

If the determination unit 22 determines based on the peak luminance signal that the display pixels in the image do not include any display pixel having the peak value (No at Step S23), then the determination unit 22 outputs a third control signal Ctr3 indicating control of the power source to the power source control unit 25, and provides the gray-level values of the respective display pixels to the correction unit 24.

When receiving the third control signal Ctr3 from the determination unit 22, the power source control unit 25 decreases both the power source voltage AVDD supplied to the source driver 30 and the driving voltage VTFT supplied to the sub-pixel units (Step S23). An amount of decrease in the power source voltage AVDD is determined, for example, to cause an amount of decrease in the reference voltage VR to be ΔVR2 as indicated in FIG. 5.

If the determination unit 22 determines based on the peak luminance signal that the display pixels in the image include a display pixel having the peak value (Yes at Step S23), then the determination unit 22 provides the gray-level values of the respective display pixels included in the image to the correction unit 24. In this case, the determination unit 22 does not output the third control signal Ctr3 to the power source control unit 25.

[2-3. Effects and the Others]

As described above, the organic EL display according to Embodiment 2 decreases the voltages AVDD and VTFT together when the peak luminance signal indicates that the display pixels in the image do not include a display pixel having the peak value. As a result, the organic EL display according to Embodiment 2 is capable of decreasing a voltage to be outputted from the source driver 30 and thereby reducing power consumption of the source driver 30 in the same manner as Embodiment 1.

Although the peak luminance signal is used as the external control signal in Embodiment 2, the present disclosure is not limited to this. For example, a display device such as a liquid crystal display or the like may use a backlight control signal or the like as the external control signal.

OTHER EMBODIMENTS

As above, Embodiments 1 and 2 have been described as examples of the technique disclosed in the present application. However, the technique according to the present disclosure is not limited to the embodiments, and appropriate modifications, substitutions, additions, eliminations, and the like can be made in the embodiments. Furthermore, it is also possible to combine the constituent elements described in Embodiments 1 and 2 to provide a new embodiment.

Although Embodiments 1 and 2 describe the case of the organic EL display, the present disclosure is not limited to this example. The present disclosure may be applied to other display devices including a liquid crystal display.

Although in Embodiment 1 both the black peak compression by which gray-level values are changed and the white peak compression by which the power source voltage AVDD supplied to the source driver 30 and the driving voltage VTFT supplied to the driving transistor Trd are decreased together are performed in combination, the present disclosure is not limited to this. It is also possible to perform either the black peak compression or the white peak compression.

Furthermore, although the white peak compression is performed in the case where the black peak compression is not performed in Embodiment 1, the present disclosure is not limited to this example. For example, in the case where an appearance frequency of display pixels having a low gray-level value is lower than or equal to the first reference ratio, and an appearance frequency of display pixels having a high gray-level value is lower than or equal to the second reference ratio, it is possible to compare the two appearance frequencies in order to determine processing to be performed. More specifically, it is possible that, by comparing an appearance frequency of display pixels having a low gray-level value to an appearance frequency of display pixels having a high gray-level value, the black peak compression is performed when the appearance frequency of display pixels having a low gray-level value is lower than the appearance frequency of display pixels having a high gray-level value, and the white peak compression is performed when the appearance frequency of display pixels having a high gray-level value is lower than the appearance frequency of display pixels having a low gray-level value.

Although the display pixels are display pixels included in one frame in Embodiments 1 and 2, the present disclosure is not limited to this example. The display pixels may be display pixels included in a sub-frame that is obtained by dividing one frame into pieces. In other words, it is possible that one frame includes a block on which the black peak compression is performed, a block on which the white peak compression is performed, and a block on which neither the black peak compression nor the white peak compression is performed. In this case, an appearance frequency may be calculated for each block.

Although in Embodiments 1 and 2, as an example of the first reference frequency according to the aspect of the present disclosure, the first reference ratio that is a ratio of the number of display pixels having a low gray-level value to the total number of the display pixels included in the image is used, the present disclosure is not limited to this example. If the total number of the display pixels included in the image is known, the first reference frequency may be other index, such as a reference number defined by the number of display pixels having a low gray-level value. In the same manner, the second reference frequency is not limited to the second reference ratio.

Thus, the embodiments have been described as examples of the technique according to the present disclosure. The accompanying drawings and the detailed description are therefore given.

Therefore, in order to provide the examples of the technique, among the constituent elements illustrated in the accompanying drawings and described in the detailed description, there may be constituent elements not essential to solve the problem as well as essential constituent elements. It is therefore not reasonable to easily consider these unessential constituent elements as essential merely because the elements are illustrated in the accompanying drawings or described in the detailed description.

It should also be noted that, since the above-described embodiments exemplifies the technique in the present disclosure, various modifications, substitutions, additions, or eliminations, for example, may be made in the embodiments within a scope of the appended claims or within a scope of equivalency of the claims.

INDUSTRIAL APPLICABILITY

The present disclosure is applicable to display devices having a source driver. More specifically, the present disclosure is applicable to organic EL displays, liquid crystal displays, smartphones, tablet terminals, and the like.

The invention claimed is:

1. A display device comprising:

a plurality of pixel units;

a source driver that applies, to data signal lines connected to the pixel units, voltages corresponding to gray-level values of display pixels included in an image indicated by an image signal; and a control unit configured to control operations of the pixel units and the source driver, wherein each of the pixel units includes (i) a light-emitting element that emits light according to a driving current, (ii) a capacitance element that accumulates electrical charge corresponding to a voltage among the voltages which is applied to a data signal line connected to the pixel unit among the data signal lines, and (iii) a driving transistor that supplies the driving current corresponding to the electrical charge accumulated in the capacitance element to the light-emitting element, the driving transistor is a P-channel transistor, and the control unit is configured to decrease at least one of the voltages to be outputted from the source driver, when an appearance frequency of at least one display pixel having a low gray-level value lower than or equal to a first reference value among the display pixels is lower than a first reference frequency, or when an appearance frequency of at least one display pixel having a high gray-level value higher than or equal to a second reference value among the display pixels is lower than a second reference frequency.

2. The display device according to claim 1, wherein the control unit is configured to increase a smallest gray-level value of a display pixel among the display pixels, when the appearance frequency of the at least one display pixel having the low gray-level value is lower than the first reference frequency.

3. The display device according to claim 1, further comprising a power circuit that supplies a source-driver power source voltage to the source driver and a driving power source voltage to the pixel units, wherein the control unit is configured to cause the power circuit to decrease the source-driver power source voltage, when the appearance frequency of the at least one display pixel having the high gray-level value is lower than the second reference frequency.

4. The display device according to claim 3, wherein the capacitance element has one end electrically connected to a power line for supplying the driving power source voltage and an other end electrically connected to the data signal line, and the control unit is configured to cause the power circuit to decrease the driving power source voltage together with the source-driver power source voltage.

5. The display device according to claim 1, wherein the control unit is configured to:

calculate a number of the at least one display pixel having the low gray-level value;

determine whether or not a low gray-level ratio is lower than or equal to a predetermined first reference ratio, the low gray-level ratio being a ratio of the number of the at least one display pixel having the low gray-level value to a total number of the display pixels; and (i) avoid decreasing the at least one of the voltages to be outputted from the source driver when the low gray-level ratio is higher than the predetermined first reference ratio, and (ii) decrease the at least one of the voltages to be outputted from the source driver when the low gray-level ratio is lower than or equal to the predetermined first reference ratio.

6. The display device according to claim 1, wherein the control unit is configured to:

calculate a number of the at least one display pixel having the high gray-level value;

determine whether or not a high gray-level ratio is lower than or equal to a predetermined second reference ratio, the high gray-level ratio being a ratio of the number of the at least one display pixel having the high gray-level value to a total number of the display pixels; and (i) avoid decreasing the at least one of the voltages to be outputted from the source driver when the high gray-level ratio is higher than the predetermined second reference ratio, and (ii) decrease the at least one of the voltages to be outputted from the source driver when the high gray-level ratio is lower than or equal to the predetermined second reference ratio.

7. The display device according to claim 1, wherein the control unit is configured to determine based on a control signal inputted from outside whether or not the display pixels include a display pixel having a greatest gray-level value, and to (i) avoid decreasing the at least one of the voltages to be outputted from the source driver when the display pixels include a display pixel having the greatest gray-level value and (ii) decrease the at least one of the voltages to be outputted from the source driver when the display pixels do not include a display pixel having the greatest gray-level value.

8. The display device according to claim 1, wherein the display device is an organic electroluminescent display, and the light-emitting element is an organic electroluminescent element.

9. A display method used by a display device that includes: a plurality of pixel units; a source driver that applies, to data signal lines connected to the pixel units, voltages corresponding to gray-level values of display pixels included in an image indicated by an image signal; and a control unit configured to control operations of the pixel units and the source driver, wherein each of the pixel units includes (i) a light-emitting element that emits light according to a driving current, (ii) a capacitance element that accumulates electrical charge corresponding to a voltage among the voltages which is applied to a data signal line connected to the pixel unit among the data signal lines, and (iii) a driving transistor that supplies the driving current corresponding to the electrical charge accumulated in the capacitance element to the light-emitting element, and the driving transistor is a P-channel transistor, the display method comprising decreasing at least one of the voltages to be outputted from the source driver, when an appearance frequency of at least one display pixel having a low gray-level value lower than or equal to a first reference value among the display pixels is lower than a first reference frequency, or when an appearance frequency of at least one display pixel having a high gray-level value higher than or equal to a second reference value among the display pixels is lower than a second reference frequency.

* * * * *